US007876198B2

(12) United States Patent
Zhao

(10) Patent No.: US 7,876,198 B2
(45) Date of Patent: Jan. 25, 2011

(54) ADAPTIVE INTELLIGENT ELECTRONIC HORN

(76) Inventor: Hongwei Zhao, P.O. Box 166-13, Taipei (TW) 115

( * ) Notice: Subject to any disclaimer, the term of this patent is extended or adjusted under 35 U.S.C. 154(b) by 261 days.

(21) Appl. No.: 12/214,484

(22) Filed: Jun. 16, 2008

(65) Prior Publication Data

US 2008/0309466 A1 Dec. 18, 2008

(30) Foreign Application Priority Data

Dec. 30, 2005 (CN) ..... 2005 1 0131359

(51) Int. Cl.
*G08B 3/10* (2006.01)

(52) U.S. Cl. ..... 340/384.7; 340/384.1; 340/384.73; 340/388.1; 340/384.4; 166/137; 166/142; 331/173; 331/177 R

(58) Field of Classification Search ..... 340/384.7, 340/384.1, 384.73, 388.1, 384.4; 166/137 R, 166/142 R; 331/173, 177 R
See application file for complete search history.

(56) References Cited

U.S. PATENT DOCUMENTS 6,211,774 B1 * 4/2001 Steiner ..... 340/384.7
6,456,193 B1 * 9/2002 Wan ..... 340/384.1

* cited by examiner

*Primary Examiner*—Tai T Nguyen

(57) ABSTRACT

An adaptive intelligent electronic horn (100) comprises a mechanical soniferous apparatus (112), an electromagnetic coil (106), a driver circuit (104) and an oscillating circuit (102). A sensor (110) is provided between the mechanical soniferous apparatus (112) and the oscillating circuit (102). An on-off ratio adjusting circuit (108) is provided at the input end of the oscillating circuit (102). The sensor (110) measures the oscillation frequency of the mechanical soniferous apparatus (112) and feedbacks the measured oscillation frequency signal to the oscillating circuit (102). The on-off ratio adjusting circuit (108) controls a pulse width of an oscillation signal from the oscillating circuit (102) based on a voltage of power supply and/or an ambient temperature. The oscillating circuit (102) outputs corresponding oscillation signal to the driver circuit (104) based on the oscillation frequency signal received from the sensor (110) and/or the control signal from the on-off ratio adjusting circuit (108).

6 Claims, 2 Drawing Sheets

ADAPTIVE INTELLIGENT ELECTRONIC HORN

FIELD OF THE INVENTION

The present invention is related to an electronic horn; particularly, to an adaptive intelligent electronic horn (100) changes volume according to a changing circumstance, and takes advantage of the surroundings as part of the horn.

BACKGROUND OF THE INVENTION

Usually, an electronic horn reached required sound levels are driven by an electronic switch to determine whether an electromagnetic coil (106) disposed inside the horn is open or closed. Then, at least, movements of a larger flat diaphragm (i.e. mechanical soniferous apparatus (112)) instead of the actual horn ducting may help resonate the sound.

Under such circumstance, the electromagnetic coil (106) driven by the electronic switch to be open or closed at a fixed on-off ratio. However, oscillation frequency of the mechanical soniferous apparatus (112) or the like is subject to variations due to ambient environment changing. Such as ambient temperature around the mechanical soniferous apparatus (112) rising may reverse the oscillation frequency of the same. But lowering the temperature may frequent the oscillation. It leads to a mechanical problem that the mechanical soniferous apparatus (112) or the like could not be operated within thoroughly harmony resonance. Max output voice voltage of the horn (without power or the mechanical soniferous apparatus (112) resonate the sound) works out substantially a lower-than-nominal threshold voltage.

Besides, the voltage fed into the electronic horn changed also detrimentally affects the actual output voice voltage. When the voltage power source turned into high voltage output with an increased current supply to the electromagnetic coil (106)—output voice voltage is substantially raised with charging. Conversely, low voltage output reduces the current supply to the electromagnetic coil (106) with a substantially lowered output voice voltage. Further, the electronic horn is subject to induced noise, for example, such as al knurled knob collided with a gag bit in a mechanical soniferous apparatus (112) of the present invention due to a gap between them becomes too small to silent them in between.

Summed up, the electronic horn outputs sound levels is conditioned by environmental factors and voltage power source; actually still does not go with what users feel or desire.

SUMMARY OF THE INVENTION

Accordingly, the present invention is to provide an adaptive intelligent electronic horn (100) adapted to ambient environment changing and voltage power source alterations with thoroughly max voice voltage output.

Said adaptive intelligent electronic horn (100) includes a mechanical soniferous apparatus (112), an electromagnetic coil (106), a driver circuit (104), and an oscillating circuit; a sensor (110) is provided between said mechanical soniferous apparatus (112) and said oscillating circuit; an on-off ratio adjusting circuit (108) is provided at an input end of the oscillating circuit. The sensor (110) is used to measure the oscillation frequency of the mechanical ratio adjusting circuit and feedback the measured oscillation frequency signal to the oscillating circuit.

The on-off ratio adjusting circuit (108) is used to control a pulse width of an oscillation signal from the oscillating circuit (102) based on a voltage of power supply and/or an ambient temperature.

The oscillating circuit (102) is used to output corresponding oscillation signal to the driver circuit (104) based on the oscillation frequency signal received from the sensor (110) and/or the control signal from the on-off ratio adjusting circuit (108).

Said sensor (110) can be replaced by a sound sensor, a oscillation sensor, or magnetic induction sensor, or capacitive sensor.

Said on-off ratio adjusting circuit (108) includes thermally controlled on-off ratio adjusting circuit (108A), or voltage controlled on-off adjusting circuit (108B).

Said thermally controlled on-off ratio adjusting circuit (108A) is used to control a pulse width of an oscillation signal from the oscillating circuit (102) based on a voltage of power supply and/or an ambient temperature.

Said voltage controlled on-off ratio adjusting circuit (108B) is used to control a pulse width of an oscillation signal from the oscillating circuit (102) based on a voltage of power supply and/or an ambient temperature.

When the ambient temperature is lowered, the thermally controlled on-off ratio adjusting circuit (108A) generates narrow pulse widths; conversely, when raised, the same generates wide range pulse width.

In the present invention, with increased sensors and on-off ratio adjusting circuit (108), oscillation frequency of oscillation signals from the oscillating circuit (102) is in resonance the oscillation occurs at a specific frequency of the mechanical soniferous apparatus (112) not affected by ambient environment changing or voltage power source alterations. The mechanical soniferous apparatus (112) outputs max voice voltage with harmony resonances.

DETAILED DESCRIPTION OF THE PREFERRED EMBODIMENTS OF THE INVENTION

The description is described in detail according to the appended drawings hereinafter.

In the present invention, with pulse width and oscillation frequency of oscillation signals from an oscillating circuit, a mechanical soniferous apparatus (112) oscillates under harmony resonance outputs max voice voltage.

Figure 1:
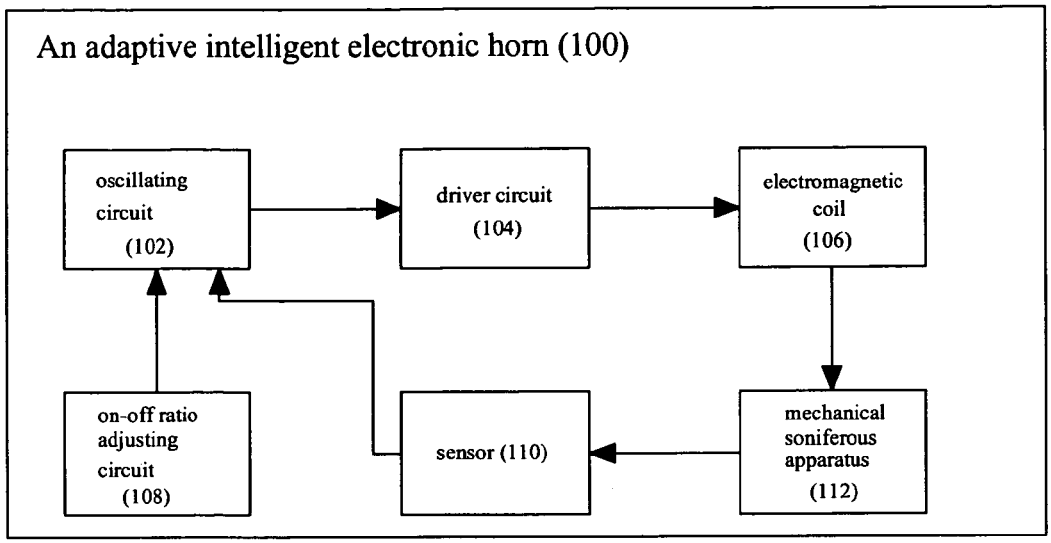
FIG. 1: is a diagrammatic view of one embodiment of the adaptive intelligent electronic horn (100) of the present invention.

As shown in FIG. 1, an adaptive intelligent electronic horn (100) includes said mechanical soniferous apparatus (112), an electromagnetic coil (106), a driver circuit (104), and said oscillating circuit; a sensor (110) is provided between said mechanical soniferous apparatus (112) and said oscillating circuit; an on-off ratio adjusting circuit (108) is provided at an input end of the oscillating circuit.

The sensor (110) is used to measure the oscillation frequency of the mechanical ratio adjusting circuit and feedback the measured oscillation frequency signal to the oscillating circuit.

Said sensor (110) can be selected from a sound sensor, a oscillation sensor, or magnetic induction sensor, or capacitive sensor.

The on-off ratio adjusting circuit (108) is used to control a pulse width of an oscillation signal from the oscillating circuit (102) based on a voltage of power supply and/or an ambient temperature.

The oscillating circuit (102) is used to output corresponding oscillation signal to the driver circuit (104) based on the oscillation frequency signal received from the sensor (110) and/or the control signal from the on-off ratio adjusting circuit (108).

Figure 2:
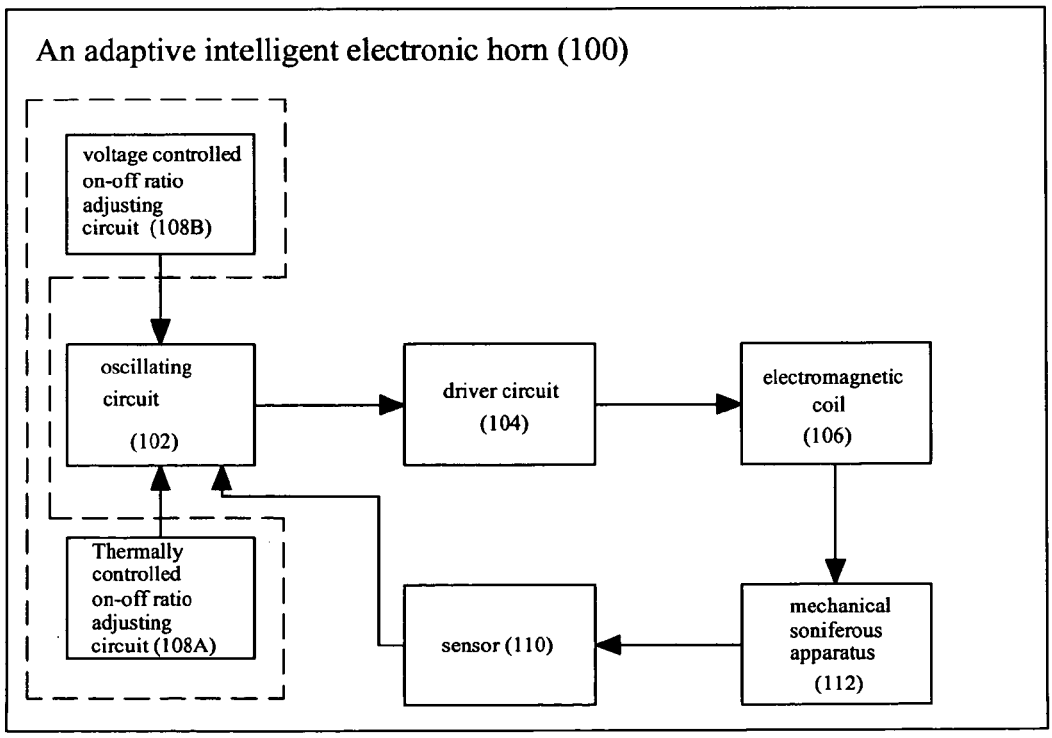
FIG. 2: is a diagrammatic view of an alternative embodiment.

As shown in FIG. 2, said on-off ratio adjusting circuit (108) includes thermally controlled on-off ratio adjusting circuit (108A), or voltage controlled on-off adjusting circuit (108B).

Said thermally controlled on-off ratio adjusting circuit (108A) is used to control a pulse width of an oscillation signal from the oscillating circuit (102) based on a voltage of power supply and/or an ambient temperature. Usually, a gap between a knurled knob and a gag bit of the mechanical soniferous apparatus (112) can be adjusted to alternate output sound levels. When temperature is lowered, the gap is decremented to output increased voice voltage, but the electronic horn is subject to induced noise as the knurled knob collided with the gag bit. While temperature is raised; the gap enlarged outputs decreased voice voltage.

Said thermally controlled on-off ratio adjusting circuit (108A) is used to control a pulse width of an oscillation signal from the oscillating circuit (102) based on a voltage of power supply and/or an ambient temperature.

When the ambient temperature is lowered, the thermally controlled on-off ratio adjusting circuit (108) generates narrow pulse widths; conversely, when raised, the same generates wide range pulse width.

Said voltage controlled on-off ratio adjusting circuit (108B) is used to control a pulse width of an oscillation signal from the oscillating circuit (102) based on a voltage of power supply and/or an ambient temperature. Voltage power source with a constant voltage, the gap between a knurled knob and a gag bit of the mechanical soniferous apparatus (112) can be adjusted to alternate output sound levels. As the gap enlarged, the electronic horn outputs lower voice voltage. Conversely, the gap shortened; the electronic horn output higher voice voltage. But, when voltage power source turned into high voltage output with an increased current supply to the electromagnetic coil (106); output voice voltage is substantially raised with charging Since oscillation amplitude of the mechanical soniferous apparatus (112) is increased, usually noise induced as the gag bit is collided with the knurled knob.

Said voltage controlled on-off ratio adjusting circuit (108B) is used to control a pulse width of an oscillation signal from the oscillating circuit (102) based on a voltage of power supply and/or an ambient temperature.

When voltage power source turned into high voltage output, said pulse width reduced, the electromagnetic coil charged with decremented power gain. Oscillation amplitude of the mechanical soniferous apparatus lessened to avoid from inducing noise. Conversely, when voltage output lowered, said pulse width enlarged, the electromagnetic coil charged with incremented power gain. Oscillation amplitude of the mechanical soniferous apparatus increased to output max voice voltage.

The sensor (110) is used to measure the oscillation frequency of the mechanical ratio adjusting circuit and feedback the measured oscillation frequency signal to the oscillating circuit. When the mechanical soniferous apparatus is not oscillated with a constant frequency, which is changing, the sensor (110) feedbacks the instant oscillation signal to the oscillating circuit, which adjusts an output of the oscillation signal. Thus, the oscillating circuit is in resonance the oscillation occurs at a specific frequency of the mechanical soniferous apparatus, which works out harmony resonance with constant amplitude and output max voice voltage.

With increased sensor and on-off ratio adjusting circuit (108), oscillation frequency of oscillation signals from the oscillating circuit (102) is in resonance the oscillation occurs at a specific frequency of the mechanical soniferous apparatus (112) not affected by ambient environment changing or voltage power source alterations. The mechanical soniferous apparatus (112) outputs max voice voltage with harmony resonances.

Figure 3:
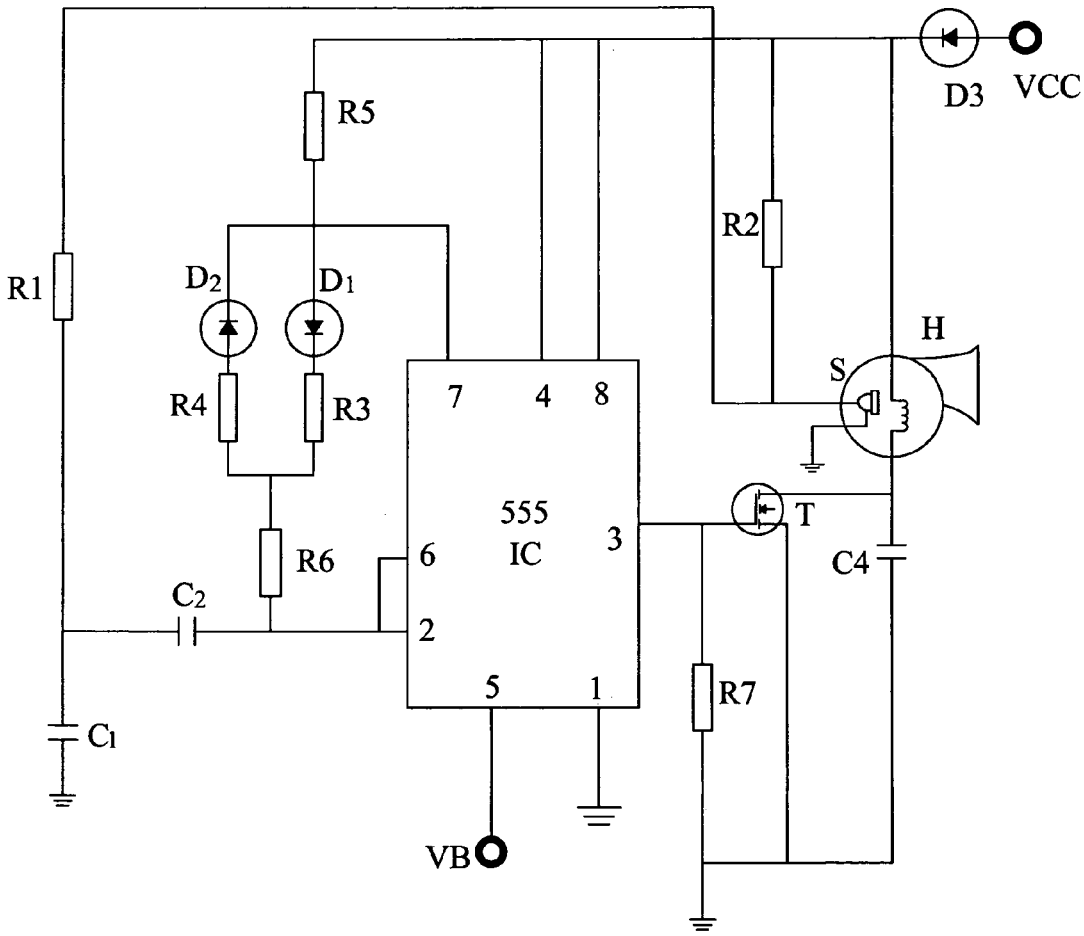
FIG. 3: is a diagrammatic view of wiring of the adaptive electronic horn of the present invention.

As shown in FIG. 3, a sensor (S) is first in parallel connection with a resistor (R2); both further in series connection with a resistor (R1). Said sensor (S) is disposed adjacent to the mechanical soniferous apparatus (H). Using 555 timer chip as said oscillating circuit with resistors (R3, R4), temperature sensitive resistor (R6), diodes (D1, D2) and capacitors (C1, C2) as exterior elements added to the 555 timer chip. The resistor (R4) in series connection with said diode (D1) and said capacitors (C1, C2) can generate on-off ratio adjusting signals in resonance the oscillation at a specific frequency of the mechanical soniferous apparatus (H). Said driver circuit is composed of a high-power field effect transistor (T) and said capacitor (C4). Said capacitor (C4) is in parallel connection with an output end of the high-power field effect transistor (T). Pin 3 of 555 timer chip is used as an output end of the oscillation signal to control on/off ratio adjusting of the high-power field effect transistor (T). Said capacitor (C4) is designed to provide an over voltage protective to the high-power field effect transistor (T), which may otherwise breakdown. Said sensor (S) feedbacks oscillation signals of the mechanical soniferous apparatus (H) to pins 2, 6 of the 555 timer chip to generate synchronous signal corresponding to the mechanical soniferous apparatus (H) in addition to the pins 2, 6. Thus, output signals of the pin 3 of the 555 timer chip are kept abreast of signals of the instant oscillation frequency of the mechanical soniferous apparatus (H). Pin 7 of the 555 timer chip controls RC (resistor-capacitor circuit) charged/discharged current. As pin 7 of the 555 timer chip kept at high voltage, RC starts charging. But, when pin 7 kept at low voltage, RC starts discharging. When charging, current flows through said diode (D1), resistors (R4, R6), and capacitors (C2, C1). When discharging, current flows through said capacitors (C1, C2), resistors (R6, R5), and diode (D2). Resistors (R4, R6) are designed with different resistance values, which can be adjusted with a constant ratio to allow a time-base circuit (i.e. 555 timer chip) generates on-off ratio adjusting signals in resonance the oscillation occurs at a specific frequency of the mechanical soniferous apparatus (H).

What is claimed is:

1. An adaptive intelligent electronic horn (100) includes a mechanical soniferous apparatus (112), an electromagnetic coil (106) set on a side of said mechanical soniferous apparatus (112), allowing the apparatus to sound, a driver circuit (104) connected electrically with said electromagnetic coil (106) for driving the coil, and an oscillating circuit; a sensor (110) is provided between said mechanical soniferous apparatus (112) and said oscillating circuit; an on-off ratio adjusting circuit (108) is provided at an input end of the oscillating circuit; the sensor (110) is used to measure the oscillation frequency of the mechanical ratio adjusting circuit and feedback the measured oscillation frequency signal to the oscillating circuit; the on-off ratio adjusting circuit (108) is used to control a pulse width of an oscillation signal from the oscillating circuit (102) based on a voltage of power supply and/or an ambient temperature; the oscillating circuit (102) is used to output corresponding oscillation signal to the driver circuit (104) based on the oscillation frequency signal received from the sensor (110) and/or the control signal from the on-off ratio adjusting circuit (108).

2. The adaptive intelligent electronic horn (100) of claim 1 wherein said sensor (110) selected from one of the following: a sound sensor, an oscillation sensor, or a magnetic induction sensor, or a capacitive sensor.

3. The adaptive intelligent electronic horn (100) of claim 1 wherein said on-off ratio adjusting circuit (108) includes thermally controlled on-off ratio adjusting circuit (108A) and/or voltage controlled on-off adjusting circuit (108B);

said thermally controlled on-off ratio adjusting circuit (108A) is used to control a pulse width of an oscillation signal from the oscillating circuit (102) based on a voltage of power supply and/or an ambient temperature;

said voltage controlled on-off ratio adjusting circuit (108B) is used to control a pulse width of an oscillation signal from the oscillating circuit (102) based on a voltage of power supply and/or an ambient temperature.

4. The adaptive intelligent electronic horn (100) of claim 3 wherein ambient temperature lowered, the thermally controlled on-off ratio adjusting circuit (108) generates narrow pulse width; conversely, when raised, the same generates wide range pulse width.

5. The adaptive intelligent electronic horn (100) of claim 3 wherein voltage power source turned into high voltage output, said pulse width reduced; when voltage output lowered, said pulse width enlarged.

6. The adaptive intelligent electronic horn (100) of claim 1 wherein a 555 timer chip used as said oscillating circuit, resistors (R3, R4), temperature sensitive resistor (R6), diodes (D1, D2) and capacitors (C1, C2) are exterior elements of the 555 timer chip; the resistor (R4) in series connection with said diode (De and said capacitors (C1, C2) can generate on-off ratio adjusting signals in resonance the oscillation at a specific frequency of the mechanical soniferous apparatus (14); said driver circuit is composed of a high-power field effect transistor (T) and said capacitor (C4); said capacitor (C4) is in parallel connection with an output end of the high-power field effect transistor (T); pin 3 of 555 timer chip is used as an output end of the oscillation signal to control on/off ratio adjusting of the high-power field effect transistor (T); said capacitor (C4) is designed to provide an over voltage protective to the high-power field effect transistor (T); a sensor (S) is first in parallel connection with a resistor (R2); both further in series connection with a resistor (R1); said sensor (S) feedbacks oscillation signals of the mechanical soniferous apparatus (H) to pins 2, 6 of the 555 timer chip to generate synchronous signal corresponding to the mechanical soniferous apparatus (H) in addition to the pins 2, 6; output signals of the pin 3 of the 555 timer chip are kept abreast of signals of the instant oscillation frequency of the mechanical soniferous apparatus (H); pin 7 of the 555 timer chip controls RC (resistor-capacitor circuit) charged/discharged current; said pin 7 of the 555 timer chip kept at high voltage, RC starts charging; said pin 7 kept at low voltage, RC starts discharging; when charging, current flows through said diode (D1), resistors (R4, R6), and capacitors (C2, C1); when discharging, current flows through said capacitors (C1, C2), resistors (R6, R5), and diode (D2); said resistors (R4, R6) are designed with different resistance values, which can be adjusted with a constant ratio to allow 555 timer chip generates on-off ratio adjusting signals in resonance the oscillation occurs at a specific frequency of the mechanical soniferous apparatus (H).

* * * * *